US007806518B2

(12) United States Patent
Nishikawa

(10) Patent No.: US 7,806,518 B2
(45) Date of Patent: Oct. 5, 2010

(54) INKJET RECORDING HEAD AND INKJET RECORDING APPARATUS

(75) Inventor: Katsumasa Nishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 363 days.

(21) Appl. No.: 12/113,004

(22) Filed: Apr. 30, 2008

(65) Prior Publication Data

US 2008/0273056 A1 Nov. 6, 2008

(30) Foreign Application Priority Data

May 1, 2007 (JP) ..... 2007-121100

(51) Int. Cl.
*B41J 2/05* (2006.01)

(52) U.S. Cl. ..... 347/65; 347/93

(58) Field of Classification Search ..... 347/40, 347/43, 64, 65, 68, 93
See application file for complete search history.

(56) References Cited

U.S. PATENT DOCUMENTS 7,320,512 B2 * 1/2008 Muraoka ..... 347/40
7,641,317 B2 * 1/2010 Matsui et al. ..... 347/65

FOREIGN PATENT DOCUMENTS

JP 2007-015257 1/2007

* cited by examiner

*Primary Examiner*—Lamson D Nguyen
(74) *Attorney, Agent, or Firm*—Canon USA Inc IP Div

(57) ABSTRACT

An inkjet recording head in which liquid supply flow paths formed in a first plate are defined by vertical walls and inclined walls. The vertical walls are perpendicular to surfaces of corresponding recording element substrates that contact the first plate. The inclined walls are inclined with respect to these surfaces. In the liquid supply flow paths that supply ink to ink supply ports of the recording element substrates arranged in one row, the inclined walls extend in a first direction along a direction of arrangement of the recording element substrates with respect to the vertical walls. In the liquid supply flow paths that supply the liquid to the liquid supply ports of the respective recording element substrates arranged in another row that is adjacent to the one row, the inclined walls extend in a second direction, which is opposite to the first direction, with respect to the vertical walls.

7 Claims, 19 Drawing Sheets

INKJET RECORDING HEAD AND INKJET RECORDING APPARATUS

BACKGROUND OF THE INVENTION

1. Field of the Invention

The present invention relates to an inkjet recording head and an inkjet recording apparatus.

2. Description of the Related Art

A related inkjet recording apparatus is configured so that a recording head can move and scan a sheet material (recording medium) fed from a sheet-feeding unit. The recording head discharges ink in a direction orthogonal to a conveying direction of the sheet material at an image forming section. Accordingly, an image is formed by discharging ink onto the sheet material. The sheet material having the image formed thereon is, then, ejected to an ejecting section of the recording apparatus. In the inkjet recording apparatus, though depending upon a recording image, the recording head is caused to reciprocate a plurality of times when forming an image onto, for example, one A4 size sheet material. Therefore, in general, the recording speed thereof is on the order of two to a few number of sheet materials per minute. However, in recent years, a higher recording speed is demanded. To meet this demand, a full-line inkjet recording head whose recording speed is increased to approximately a few tens of sheet materials per minute as a result of arranging nozzles (for discharging ink) over the entire width of a recording medium in a direction intersecting a conveying direction of a sheet material is proposed. A recording apparatus including one or more such full-line inkjet recording heads is also proposed.

For example, a recording head that can discharge ink over an entire width of a recording medium as a result of arranging a plurality of recording element substrates (having a certain number of nozzles) on a supporting plate is proposed as a long full-line inkjet recording head having a length in the range of from, for example, 4 to 13 inches. Still another recording head in which one recording element substrate is made long over an entire width of a recording medium is proposed.

The above-described full-line inkjet recording heads and a recording apparatus including any of these inkjet recording heads are discussed in Japanese Patent Laid-Open No. 2007-015257.

However, in general, such full-line recording heads are larger than a reciprocating-scanning recording head used in a related inkjet recording apparatus. In addition, in forming a recording apparatus, for example, one inkjet recording head may be used per one ink color, as a result of which the recording apparatus includes a plurality of inkjet recording heads. Therefore, the recording apparatus that uses full-line recording heads is large. From the viewpoints of, for example, costs and space efficiency in an operating environment of a user, the recording apparatus is required to be small.

SUMMARY OF THE INVENTION

The present invention provides an inkjet recording head that can be reduced in size.

An inkjet recording head according to an aspect of the present invention includes a plurality of recording element substrates, a supporting plate, and a filter. The plurality of recording element substrates have a plurality of discharge ports, a plurality of recording elements, and a plurality of liquid supply ports. The discharge ports and the recording elements are disposed in a plurality of rows. The discharge ports discharge liquid. The recording elements generate discharge energy for discharging the liquid from the discharge ports. The liquid supply ports supply the liquid to the recording elements. The supporting plate has the recording element substrates disposed in a plurality of rows at one surface of the supporting plate in a direction of arrangement of the discharge ports and the recording elements. The supporting plate is provided with a plurality of liquid supply flow paths that supply the liquid to the liquid supply ports at the respective recording elements. The filter is disposed at a surface of the supporting plate that is opposite to the one surface of the supporting plate. Each liquid supply flow path is defined by a vertical wall and an inclined wall. Each vertical wall is perpendicular to a surface of the corresponding recording element substrate that contacts the supporting plate. Each inclined wall opposes the surface of the corresponding recording element substrate and forms an acute angle with the surface of the corresponding recording element substrate. In the liquid supply flow paths that supply the liquid to the liquid supply ports at the respective recording element substrates that are arranged in one of the rows, the inclined walls extend in a first direction along the direction of arrangement of the recording element substrates with respect to the vertical walls. In the liquid supply flow paths that supply the liquid to the liquid supply ports at the respective recording element substrates that are arranged in another of the rows that is adjacent to the one of the rows, the inclined walls extend in a second direction, which is opposite to the first direction, with respect to the vertical walls.

The present invention can provide an inkjet recording head that can be reduced in size.

Further features of the present invention will become apparent from the following description of exemplary embodiments with reference to the attached drawings.

DESCRIPTION OF THE EMBODIMENTS

Exemplary embodiments of the present invention will now be described with reference to the drawings.

First Exemplary Embodiment

Figure 1:
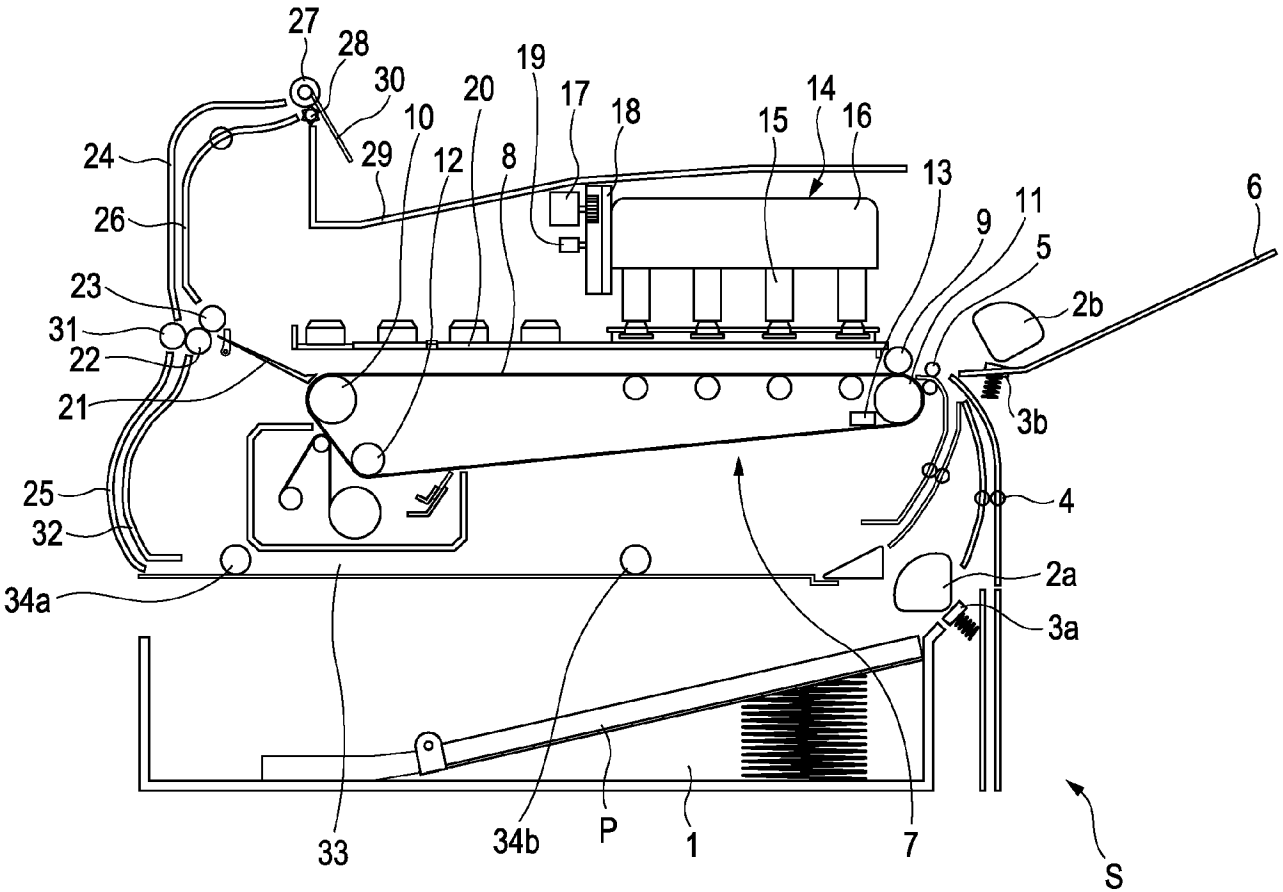
FIG. 1 is a schematic front view of an entire structure of an inkjet recording apparatus according to a first embodiment of the present invention.
Figure 2:
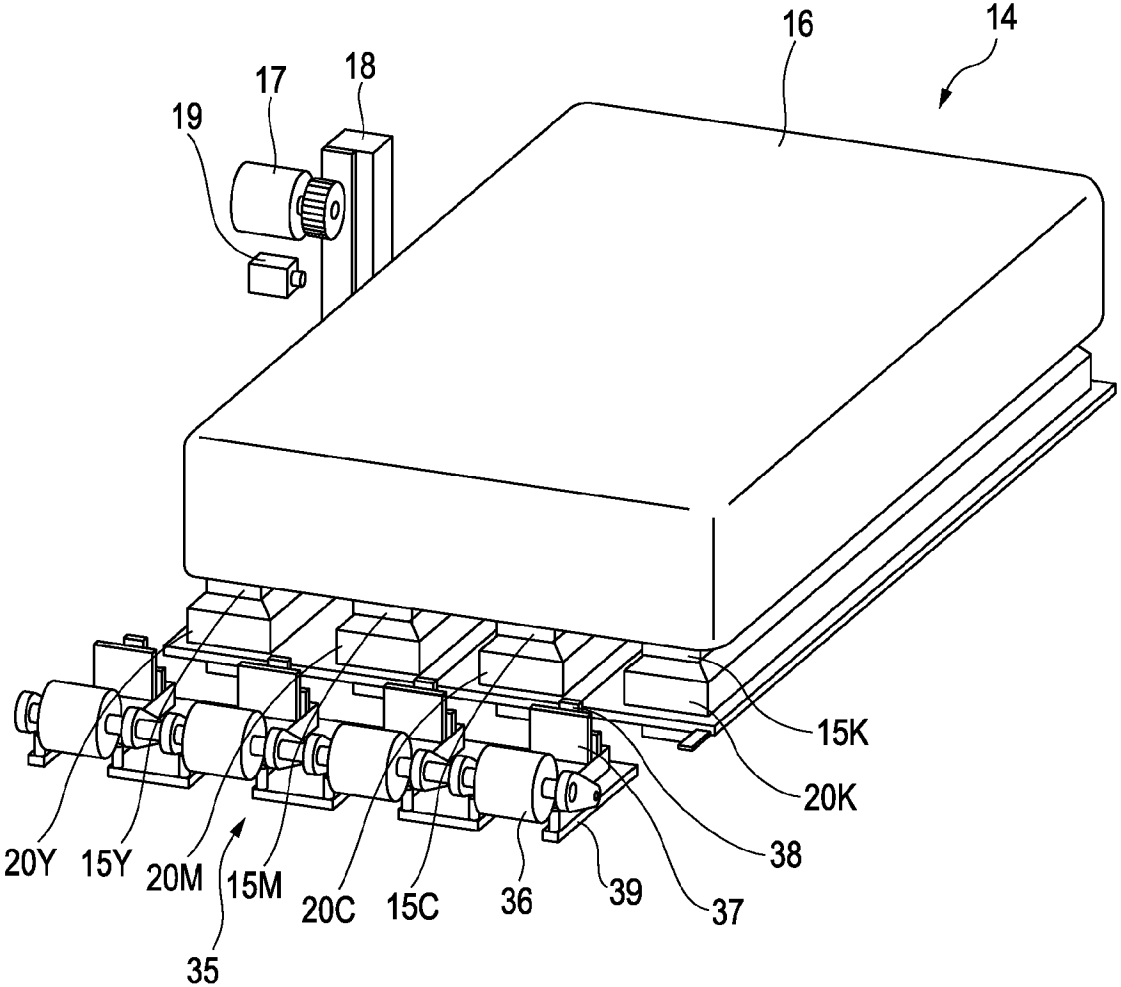
FIG. 2 is a schematic structural perspective view of a recording head unit, a cap, and a cleaning mechanism in the inkjet recording apparatus shown in FIG. 1.
Figure 3:
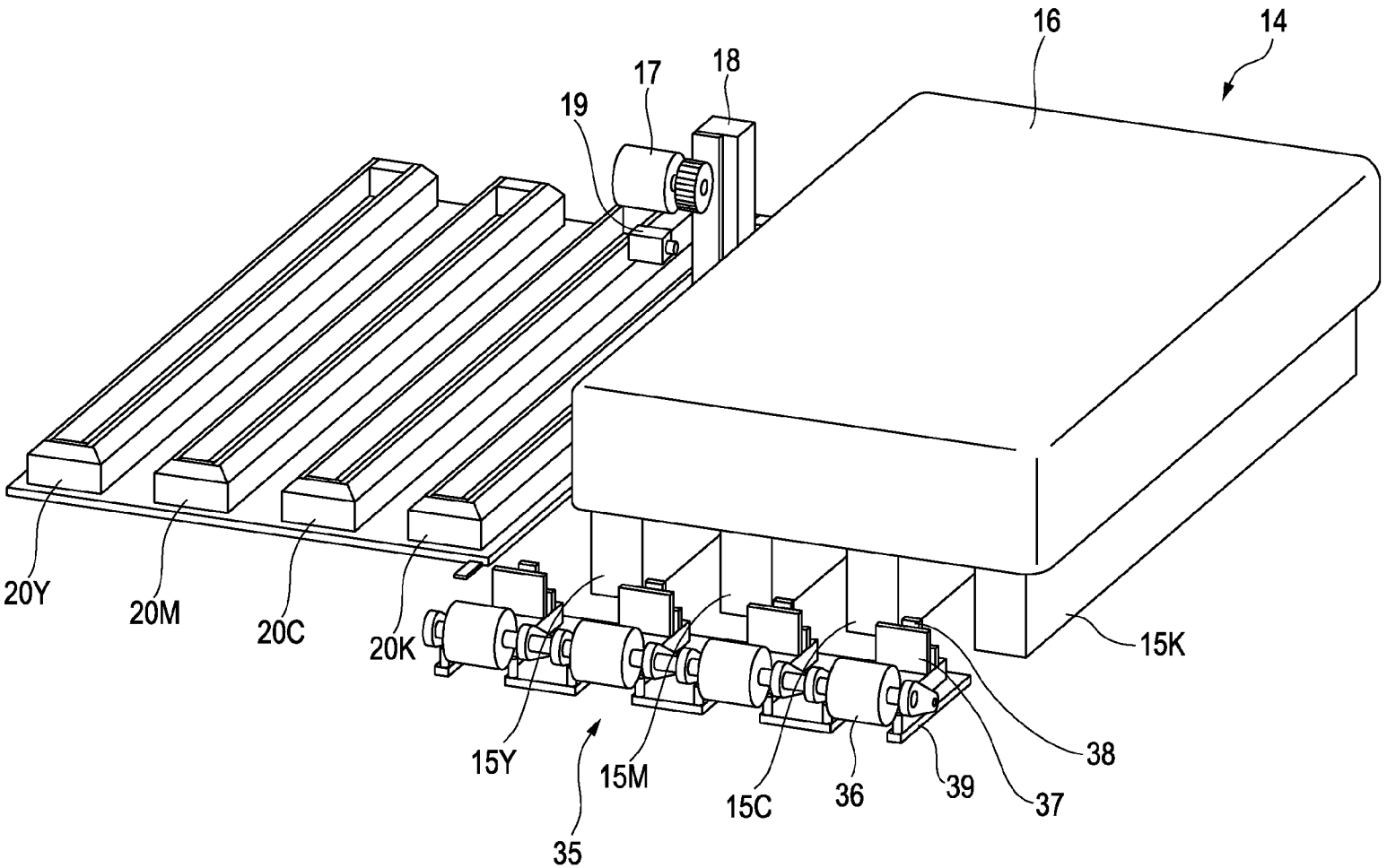
FIG. 3 is a schematic structural perspective view of the recording head unit, the cap, and the cleaning mechanism in the inkjet recording apparatus shown in FIG. 1.

FIG. 1 is a schematic front view of an entire structure of an inkjet recording apparatus according to a first embodiment of the present invention. FIGS. 2 and 3 are each a schematic structural perspective view of a recording head unit, a cap, and a cleaning mechanism in the inkjet recording apparatus shown in FIG. 1.

Referring to FIG. 1, recording sheets P, which are recording-medium sheet materials and which are held in a sheet-feed cassette 1 in an inkjet recording apparatus S, are sent out by a pickup roller 2*a* starting from a topmost sheet, and are separated and conveyed one at a time by an operation of a separating pad 3*a*. The recording sheet P fed from the sheet-feed cassette 1 is conveyed to a pair of registration rollers 5, which are not rotating, by a pair of conveying rollers 4. A manual tray 6 is provided at a side of the inkjet recording apparatus S. Here, the recording sheets P are sent out by a pickup roller 2*b*, are separated and fed one sheet at a time by a separating pad 3*b*, and are conveyed to the pair of registration rollers 5.

The recording sheet P conveyed to the pair of registration rollers 5 is sent out towards a belt conveying section 7 at a predetermined timing, and is electrostatically attracted to a conveying belt 8 just before reaching an attraction roller 9. The conveying belt 8 is wound upon a driving roller 10, a conveying roller 11, and a pressure roller 12. The driving roller 10 is a downstream-side conveying roller, and the conveying roller 11 is an upstream-side roller. A driving force is transmitted to the driving roller 10 from a drive source (not shown), and causes the conveying belt 8 to rotate. At this time, a surface of the conveying belt 8 is charged with an electrical potential by a charger 13. When the recording sheet P that is placed on the conveying belt 8 reaches the attraction roller 9 that is connected to ground, the recording sheet P and the conveying belt 8 are kept in close contact with each other by an electrostatic attraction force. Therefore, the recording sheet P that is in close contact with the conveying belt 8 moves along with the conveying belt 8.

A recording head unit 14 for forming an image on the basis of image information is provided downstream from the conveying roller 11 in a conveying direction of the recording sheet. A plurality of recording heads 15 for forming images by discharging ink is disposed in the recording head unit 14. The recording heads 15 include a recording head 15K for black ink, a recording head 15C for cyan ink, a recording head 15M for magenta ink, and a recording head 15Y for yellow ink. The recording heads 15K, 15C, 15M, and 15Y are disposed in that order from the upstream side in the conveying direction of the recording sheet P so as to be separated by a predetermined interval, and are mounted to a head holder 16.

Each recording head 15 includes an electrothermal energy converting member, such as a heater, that can apply heat to ink. The heat causes the ink to be subjected to film boiling. Growth or contraction of air bubbles produced by the film boiling causes a pressure change. This pressure change causes ink from nozzles H1105 (see FIG. 4) arranged in recording element substrates H1100 (see FIG. 4) of each recording head 15 to be discharged, so that an image is formed on the recording sheet P. When the recording sheet P passes the belt conveying section 7, images are recorded on the recording sheet P by the recording heads 15K, 15C, 15M, and 15Y for the respective colors disposed in the recording head unit 14. Each recording head 15 is formed as a full-line inkjet recording head having the nozzles H1105 arranged over the entire widths by disposing the recording element substrates H1100 in a direction orthogonal to the conveying direction of the recording sheet P. Each recording head 15 may discharge ink by other methods such as by a method of discharging ink by changing the volume of an ink chamber using a piezo element.

The head holder 16 to which each recording head 15 is secured is moved vertically by a motor 17 and a head vertical guide 18. A sensor 19, provided near the head vertical guide 18 in the recording head unit 14, defines a vertical movement distance of the head holder 16.

When the recording heads 15 are not discharging ink for forming images, they are protected by caps 20 to prevent clotting of ink at the nozzles H1105, caused by drying of the ink, or adherence of, for example, dust or dirt to the recording element substrates H1100. The caps include a cap 20K for black ink, a cap 20C for cyan ink, a cap 20M for magenta ink, and a cap 20Y for yellow ink. When images are not formed, as shown in FIG. 2, the caps 20K, 20C, 20M, and 20Y are disposed at capping positions where they protect the recording element substrates H1100 of the recording heads 15K, 15C, 15M, and 15Y of the respective colors.

When an image is to be formed, the head holder 16 is moved by a predetermined amount using the motor 17, the head vertical guide 18, and the sensor 19. In addition, as shown in FIG. 3, a drive source (not shown) moves the caps 20K, 20C, 20M, and 20Y from the respective recording heads 15K, 15C, 15M, and 15Y to evacuate positions that do not interfere with ink discharge to the recording sheet P. Using the motor 17, the head vertical guide 18, and the sensor 19, the head holder 16 is moved once again until the distance between the recording element substrates H1100 of the recording heads 15 and the recording sheet P on the conveying belt 8 becomes a predetermined value. Then, each of the recording heads 15 discharges ink of its corresponding color towards the recording sheet P. In synchronism with the movement of the recording sheet P in close contact with the conveying belt 8 below the recording head unit 14 along with the conveying belt 8, the ink is discharged by the recording heads 15 from the nozzles H1105, formed at the recording heads 15, so that an image is formed on the recording sheet P.

The recording sheet P having the image formed thereon in an area (image formation area) facing the recording head unit 14 is separated from the conveying belt by a separating guide 21, and is guided to a nip portion between a sheet-eject reversal roller 22 and a driven roller 23. The recording heads 15 having completed the ink discharge, the head holder 16, and the caps 20 are returned to their initial positions where the recording element substrates H1100 of the recording heads 15 are protected by the respective caps 20.

A cleaning mechanism 35 removes, for example, ink drops remaining on the surfaces of the recording heads 15 where the recording element substrates H1100 are mounted. The cleaning mechanism 35 has porous absorbing members that absorb, for example, ink drops remaining on the surfaces of the recording heads 15 where the recording element substrates H1100 are mounted. The cleaning mechanism 35 also has entire-surface wipers 37 formed of elastic members having widths that allow them to wipe the entire width of the recording heads 15. The entire-surface wipers 37 are provided for removing, for example, ink drops remaining on the surfaces of the recording heads 15 where the recording element substrates H1100 are mounted. Further, the cleaning mechanism 35 has nozzle wipers 38 having widths that allow them to wipe the areas of the recording heads 15 where the recording element substrates H1100 are arranged. Still further, the cleaning mechanism 35 is provided with supporting members 39 that support the absorbing members 36, the entire-surface wipers 37, and the nozzle wipers 38. Driving force from a drive source (not shown) causes the supporting members 39 to move along a rail (not shown) extending in the longitudinal direction of the recording heads 15 while the supporting members 39 contact the recording heads 15, so that the cleaning mechanism 35 cleans the recording heads 15.

The recording sheet P having the image formed thereon is nipped and conveyed by the sheet-eject reversal roller 22 and the driven roller 23. Its conveying path thereafter depends upon whether a recording mode is in a one-sided printing mode, in which an image is formed on only one surface of the recording sheet P, or in a two-sided printing mode, in which images are formed on both front and back surfaces of the recording sheet P. In the one-sided printing mode, the recording sheet P is ejected to a sheet ejecting section 24. In the two-sided printing mode, the recording sheet P is sent to a refeeding section 25 and returned into the apparatus again, so that an image is formed on the back surface. Then, the recording sheet P is conveyed to the sheet ejecting section 24 to eject the recording sheet P out of the recording apparatus.

In the one-sided printing mode, the recording sheet P having the image formed thereon passes a sheet eject path 26 from the nip portion between the sheet-eject reversal roller 22 and the driven roller 23. Then, the recording sheet P is nipped and conveyed by a sheet eject roller 27 and a driven roller 28 facing the sheet eject roller 27, and is ejected onto a sheet eject tray 29.

In the two-sided printing mode, using the sheet eject roller 27, the driven roller 28, and a sensor 30 (provided downstream from the eject roller 27 and the driven roller 28 in the conveying direction), a switching timing in the conveying direction is controlled. That is, reversing the rotations of the sheet eject roller 27 and the driven roller 28 just before a rear edge of the recording sheet P passes the nip portion between the sheet eject roller 27 and the driven roller 28 causes the recording sheet P to pass through the sheet eject path 26, and is guided to a switchback path 32 by the sheet-eject reversal roller 22 and the driven roller 31. The recording sheet P in the switchback path 32 is conveyed to a refeeding path 33. The recording sheet P is conveyed again to the pair of registration rollers 5 by refeeding rollers 34*a* and 34*b*, so that an image is formed on the back surface similarly to when an image is formed on the front surface. The recording sheet P having the image formed on the back surface is guided to the sheet eject path 26 as it is in the one-sided printing mode. Then, the recording sheet R is nipped and conveyed by the sheet eject roller 27 and the driven roller 28, and is ejected onto the sheet eject tray 29.

Figure 4A:
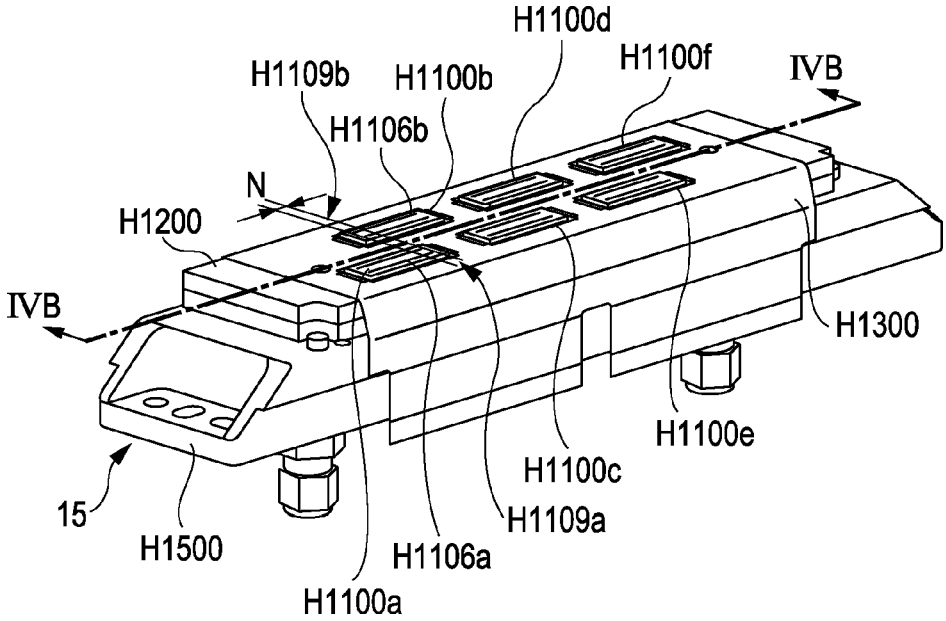
FIG. 4A is an external perspective view of a recording head.
Figure 4B:
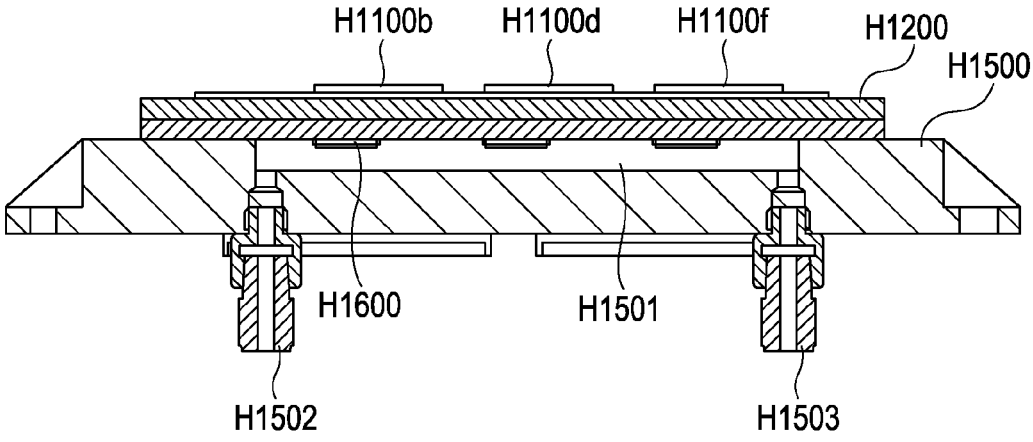
FIG. 4B is a sectional view taken along line IVB-IVB in FIG. 4A.
Figure 5:
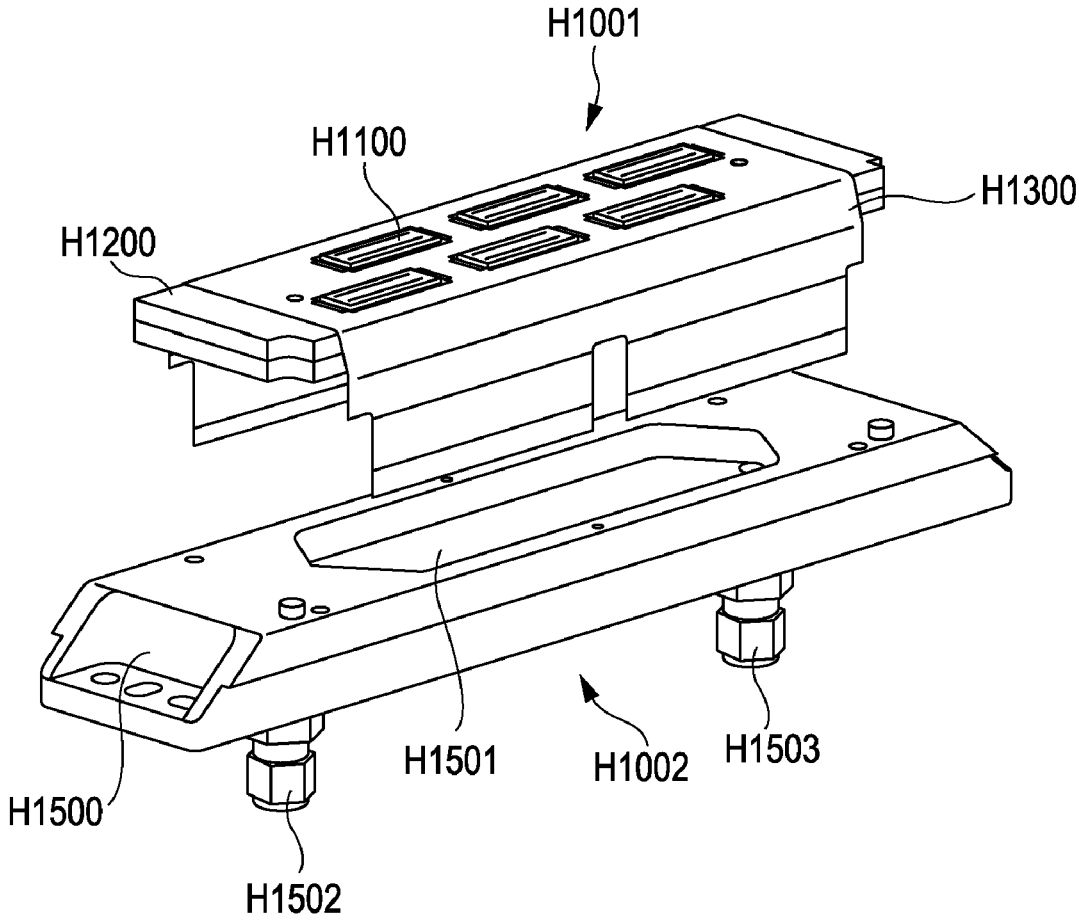
FIG. 5 is an exploded perspective view of the recording head.
Figure 6:
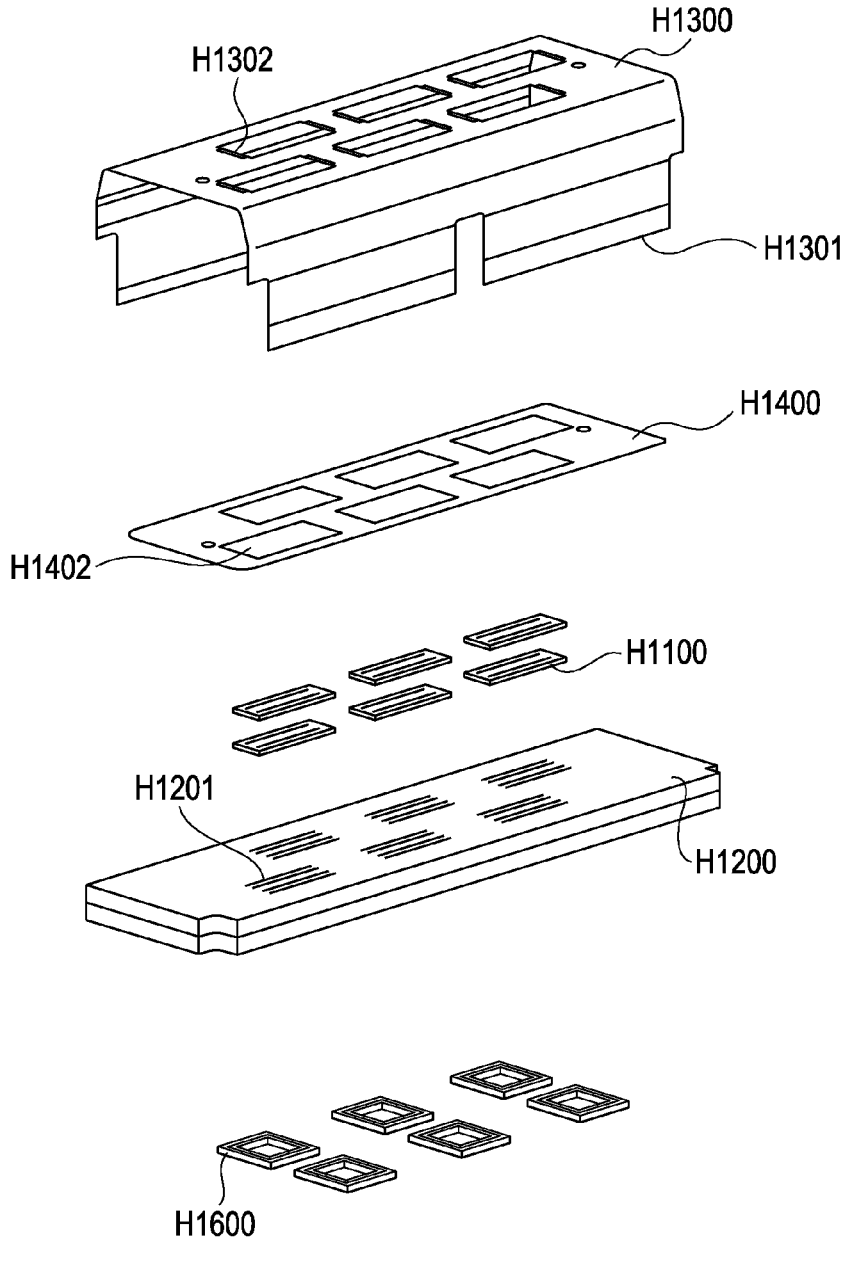
FIG. 6 is an exploded perspective view of a recording element unit of the recording head.
Figure 7A:
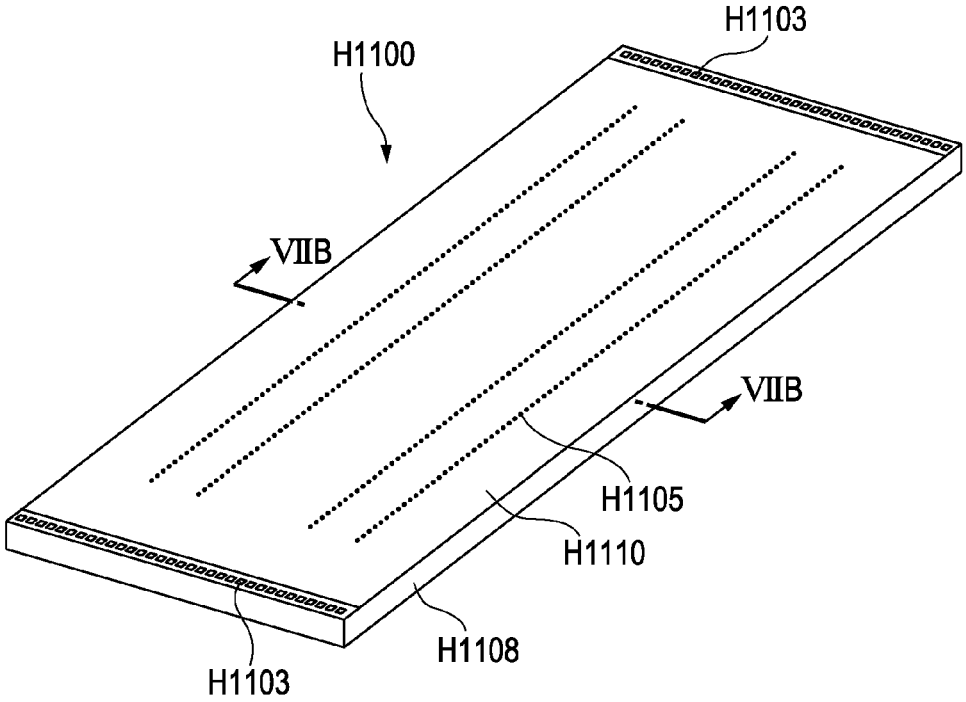
FIG. 7A is a perspective view of a recording element substrate of the recording head.
Figure 7B:
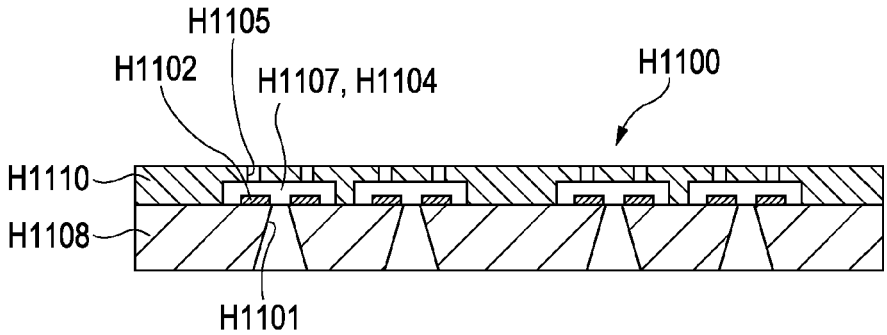
FIG. 7B is a sectional view taken along line VIIB-VIIB in FIG. 7A.
Figure 8A:
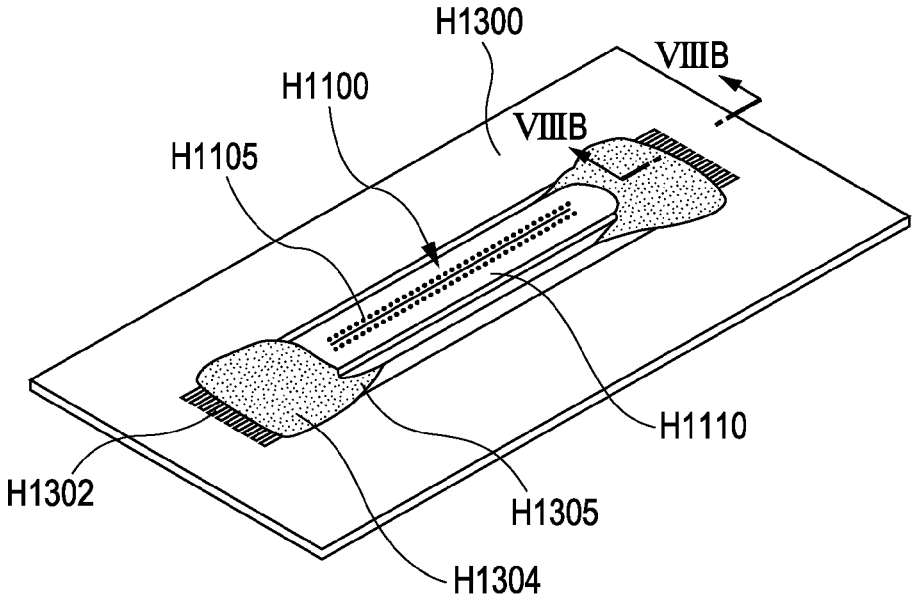
FIG. 8A is a perspective view of a wiring connection portion of an electrical wiring board and the recording element substrate.
Figure 8B:
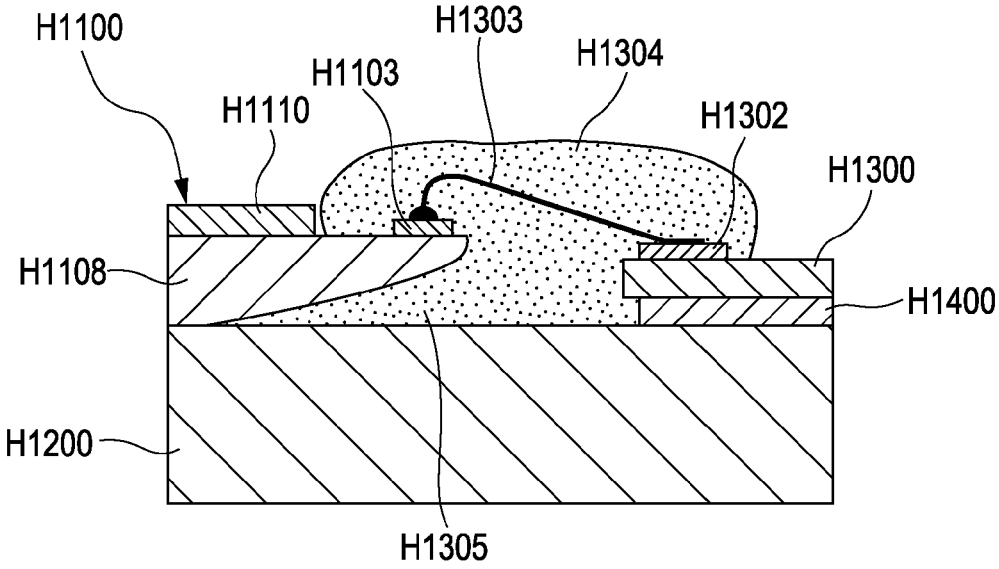
FIG. 8B is a sectional view taken along line VIIIB-VIIIB in FIG. 8A.

The structure of each recording head will now be described with reference to FIGS. 4 to 7. FIG. 4A is an external perspective view of one recording head, and FIG. 4B is a sectional view taken along line IVB-IVB in FIG. 4A. FIG. 5 is an exploded perspective view of the recording head. FIG. 6 is an exploded perspective view of the recording element unit of the recording head. FIG. 7A is a perspective view of the recording element substrate of the recording head, and FIG. 7B is a sectional view taken along line VIIB-VIIB in FIG. 7A. FIG. 8A is a perspective view of a wiring connection portion of an electrical wiring board and the recording element substrate, and FIG. 8B is a sectional view taken along line VIIIB-VIIIB in FIG. 8A.

The recording head 15 shown in FIG. 4 is a bubble jet recording head that performs a recording operation on a recording medium by causing ink to eject from a discharge port using an electrothermal converting member that generates thermal energy in accordance with an electrical signal and that causes film boiling in the ink. In addition, the recording head 15 shown in FIG. 4 is a side-shooter type recording head that discharges ink vertically with respect to the recording element substrates H1100. As mentioned above, as an energy generating element that generates energy for discharging ink from the discharge port of the recording head 15, an electromechanical converting member, such as a piezo element, may be used. Other examples of energy generating elements are an element that discharges ink drops by the action of heat generated by irradiating the element with electromagnetic waves, such as a laser, or an element that heats a liquid by an electrothermal transducer including a heating resistor. Accordingly, as the energy generating element, any of these structures may be used.

As shown in the exploded perspective view of FIG. 5, the recording head 15 includes a recording element unit H1001 and an ink supply unit H1002. As shown in the exploded perspective view of FIG. 6, the recording element unit H1001 includes the recording element substrates H1100, a first plate H1200, an electrical wiring board H1300, a second plate H1400, and filters H1600. The filters H1600 are disposed on the surface of the first plate H1200 opposite to the surface thereof where the recording element substrates H1100 are disposed.

Referring again to FIG. 5, an ink supply liquid chamber H1501 is formed in an ink supply member (liquid supply member) H1500 of the ink supply unit H1002. The ink supply liquid chamber H1501 accommodates the filters H1600 provided at the first plate H1200. The ink supply member H1500 is provided with an ink entrance member H1502 and an ink exit member H1503.

As shown in FIG. 7, the recording element substrate H1100 includes, for example, a silicon (Si) substrate H1108 having a thickness of about 0.5 to 1 mm. A plurality of ink supply ports (liquid supply ports) H1101 having long-grooved through holes is formed as ink flow paths in the Si substrate H1108. One row of electrothermal transducers H1102 is disposed on each side of each ink supply port H1101 in a staggered arrangement. The electrothermal transducers H1102 and electrical wires, such as Al electrical wires, are formed by film-deposition technology. The electrothermal transducers H1102 are recording elements that generate discharge energy for discharging ink (liquid) from the nozzles (eject ports) H1105. Electrodes H1103 for supplying electrical power to or inputting an electrical signal or outputting the electrical from the electrical wires are provided on the Si substrate H1108.

The ink supply ports H1101 are formed by anisotropic etching making use of crystal orientation of the Si substrate H1108. When the Si substrate H1108 has a crystal orientation of <111>in the thickness direction and <100> at a wafer surface, the Si substrate H1108 is etched at an angle of approximately 54.7 degrees by anisotropic etching using an alkali etching liquid such as KOH, TMAH, or hydrazine. Using this method, etching of a predetermined depth is performed.

A nozzle plate H1110 is provided on the Si substrate H1108. In the nozzle plate H1110, an ink flow path H1104, the nozzles (discharge ports) H1105, and foaming chambers H1107 are formed by photolithography techniques in correspondence with the electrothermal transducers H1102. Accordingly, the nozzles H1105 and the electrothermal transducers H1102 are disposed in rows at the recording element substrate H1100. The nozzles H1105 are positioned so as to face the electrothermal transducers H1102. Ink supplied from the ink supply ports H1101 is discharged by generating air bubbles by the electrothermal transducers H1102.

The first plate H1200, which is a supporting plate, is formed of, for example, alumina ($Al_2O_3$) having a thickness of about 0.5 to 10 mm. The material of the first plate H1200 is not limited to alumina, so that it may be formed of a material having a linear expansivity that is equal to that of the material of the recording element substrate H1100, and having a thermal conductivity greater than or equal to that of the material of the recording element substrate H1100. The material of the first plate H1200 may be any one of, for example, silicon (Si), aluminum nitride (AlN), zirconia, silicon nitride ($Si_3N_4$), silicon carbide (SiC), molybdenum (Mo), and tungsten (W). The first plate H1200 is provided with liquid supply flow paths H1201 for supplying ink to the recording element substrates H1100. The ink supply ports H1101 of the recording element substrate H1100 are formed in correspondence with the liquid supply flow paths H1201 of the first plate H1200. The recording element substrates 1100 are adhered and secured to the first plate H1200 with high positional precision. For example, an adhesive is desirably one which has low viscosity, which causes a thin adhesive layer to be formed on an adhesion surface, which is relatively hard after curing, and which is resistant to ink. For example, a thermosetting adhesive whose main component is epoxy resin or a thermosetting adhesive of an ultraviolet-curing combination type may be used. The thickness of the adhesive layer is desirably equal to or less than 50 μm.

As shown in FIG. 4, the recording element substrates H1100 are disposed in two rows in a staggered arrangement on the first plate H1200, and allow recording over a wide width using one color. In the structure shown in FIG. 4, six recording element substrates H1100*a*, H1100*b*, H1100*c*, H1100*d*, H1100*e*, and H1100*f* whose nozzle groups have a length on the order of 1.5 inches are disposed in a staggered arrangement, so that A4-width recording can be performed.

An end of the nozzle groups of each recording element substrate H1100 is provided with an overlap portion N that overlaps an end of the nozzle groups of another recording element substrate 1100 adjacent thereto in a staggered arrangement in a recording direction. This eliminates gaps between the nozzle groups of the recording element substrates H1100 in the recording direction, so that stripes in a recorded image resulting form such gaps are prevented from being formed. For example, a nozzle group H1106*a* of the recording element substrate H1100*a* is provided with an overlap area H1109*a*, and a nozzle group H1106*b* of the recording element substrate H1100*b* is provided with an overlap area H1109*b*. When there are six recording element substrates H1100 as in the embodiment, there are five nozzle overlap portions N.

Referring to FIGS. 6 and 8, the electrical wiring board H1300 is provided with a wire that applies an electrical signal for discharging ink with respect to the recording element substrate H1100. The electrical wiring board H1300 has an opening for installing the recording element substrates H1100 therein. The second plate H1400 is adhered and secured to the back surface of the electrical wiring board H1300. Further, the electrical wiring board H1300 has electrode terminals H1302 and external signal input terminals H1301. The electrode terminals H1302 are formed in correspondence with the electrodes H1103 on the recording element substrates H1100. The external signal input terminals H1301 are positioned at the ends of the electrical wiring board H1300, and receive an electrical signal from the main body of the apparatus. The electrical wiring board H1300 and the recording element substrates H1100 are electrically connected to each other. For example, wire bonding technology using gold wires H1303 can be performed on the electrodes H1103 on the recording element substrates H1100 and the electrode terminals H1302 on the electrical wiring board H1300. The electrical wiring board H1300 is, for example, a flexible wiring board whose wires are formed in two layers, with a front layer being covered with a polyimide film.

The second plate H1400 is formed of, for example, a stainless steel plate having a thickness on the order of about 0.1 to 1 mm. The material of the second plate H1400 is not limited to stainless steel, so that the material may be one that is resistant to ink and has proper flatness. The second plate H1400 is provided with the recording element substrates H1100, adhered and secured to the first plate H1200, and openings H1402, which receive the recording element substrates H1402. In addition, the second plate H1400 is adhered and secured to the first plate H1200.

As shown in FIG. 8, electrical mounting portions of the electrical wiring board H1300 and the recording element substrates H1100 are sealed by first sealants H1304. Sealed portions formed by the first sealants H1304 protrude from the recording element substrates H1100 and the electrical wiring board H1300 by amounts on the order of from 0.05 to 0.3 mm. Gaps between the recording element substrates H1100 and the electrical wiring board H1300 are sealed by second sealants H1305, so that electrical connection portions are protected from external shock and corrosion caused by ink.

The filters H1600 are adhered and secured to the liquid supply flow paths H1201 at the back surface of the first plate H1200 (see FIGS. 4B and 6). The filters prevent entry of foreign substance, mixed in ink, into the liquid supply flow paths H1201.

Figure 9:
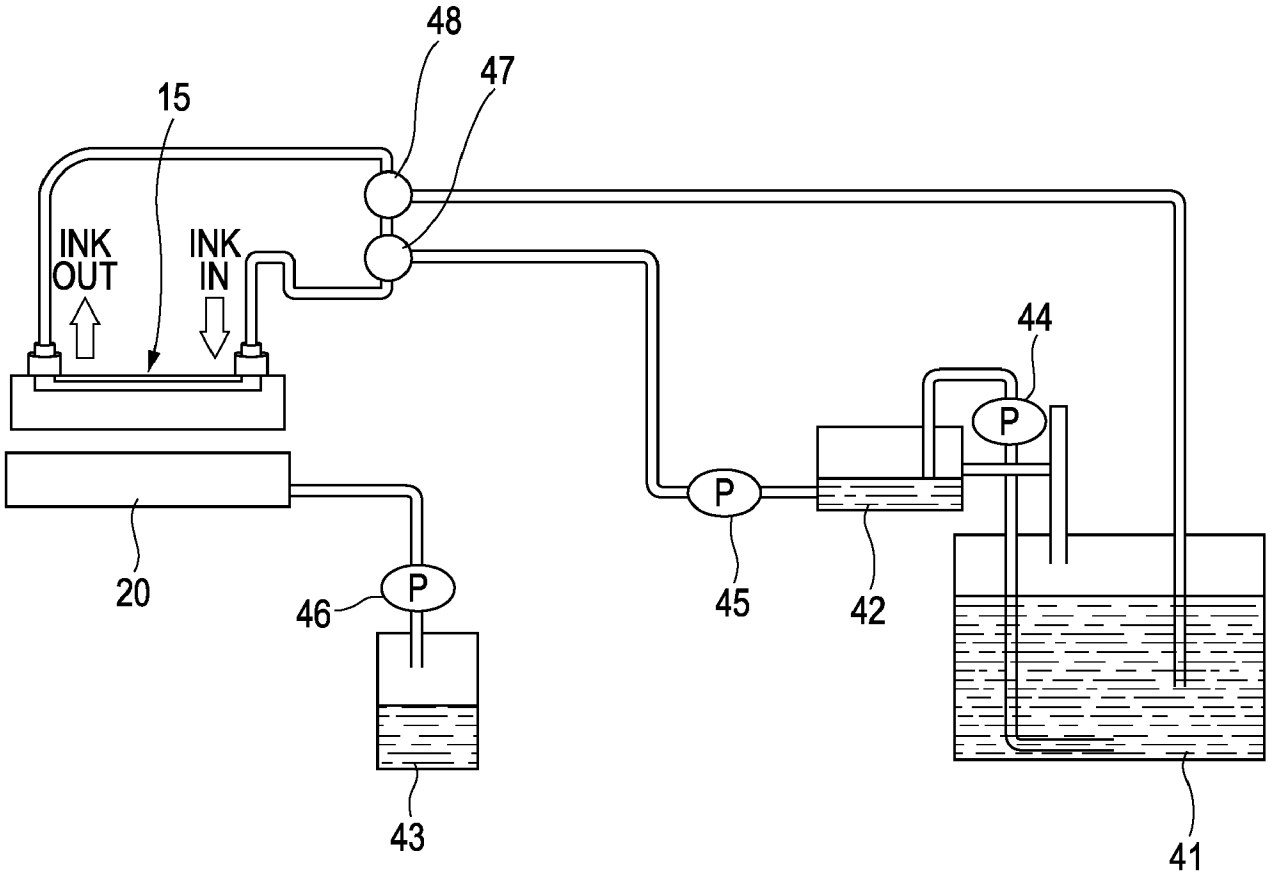
FIG. 9 is a conceptual diagram of an ink supply path.
Figure 10A:
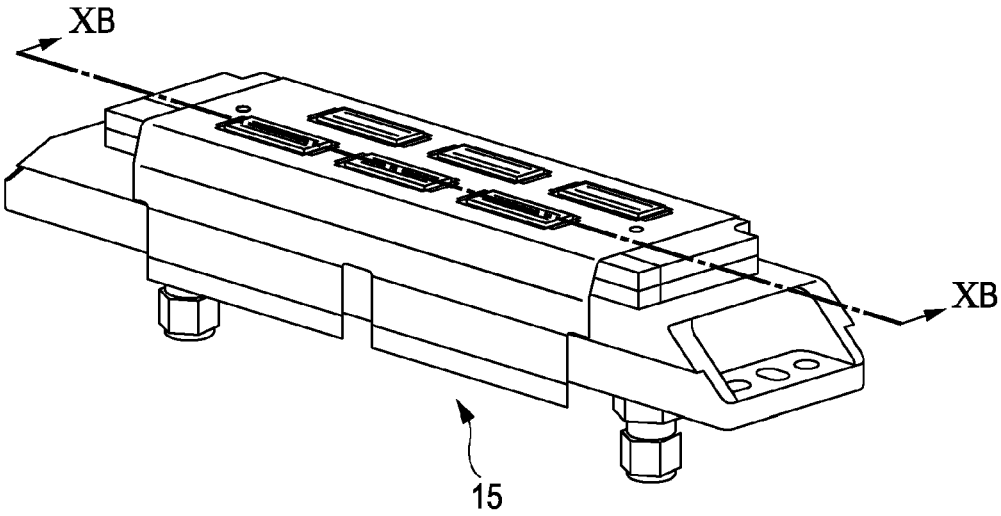
FIG. 10A is a perspective view of the recording head.
Figure 10B:
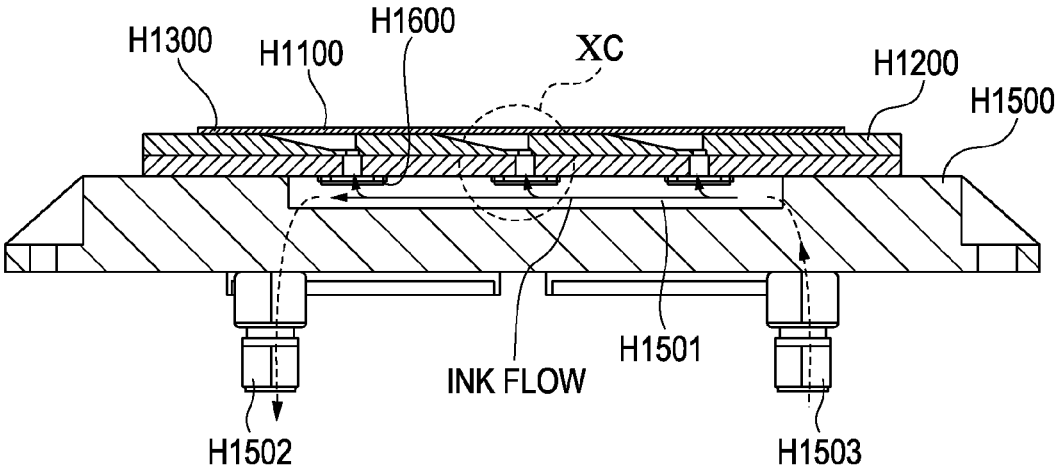
FIG. 10B is a sectional view taken along line XB-XB in FIG. 10A.
Figure 10C:
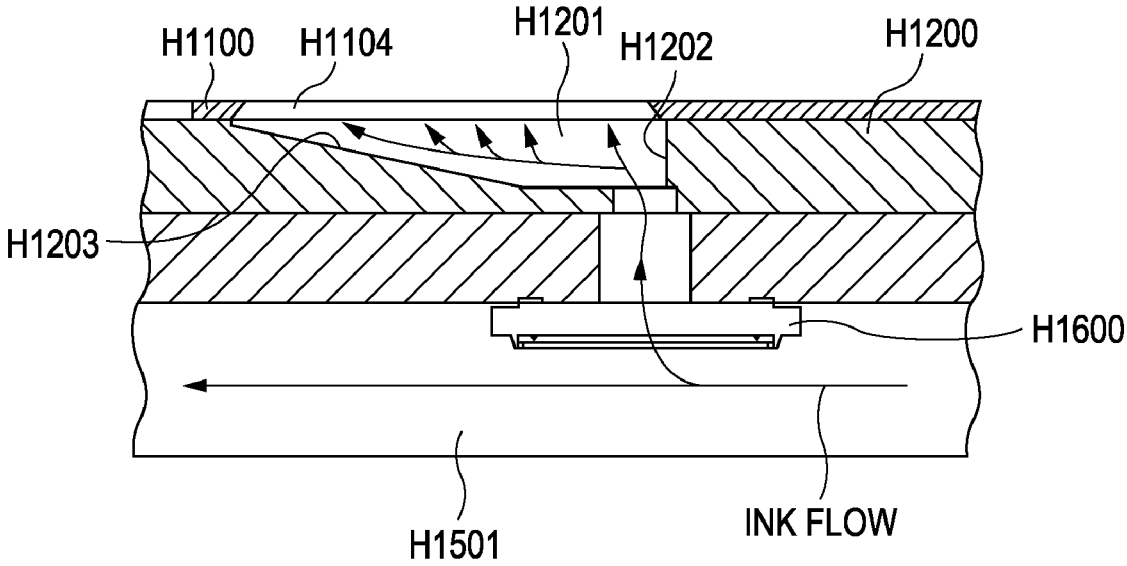
FIG. 10C is an enlarged sectional view of a portion E in FIG. 10B.
Figure 11A:
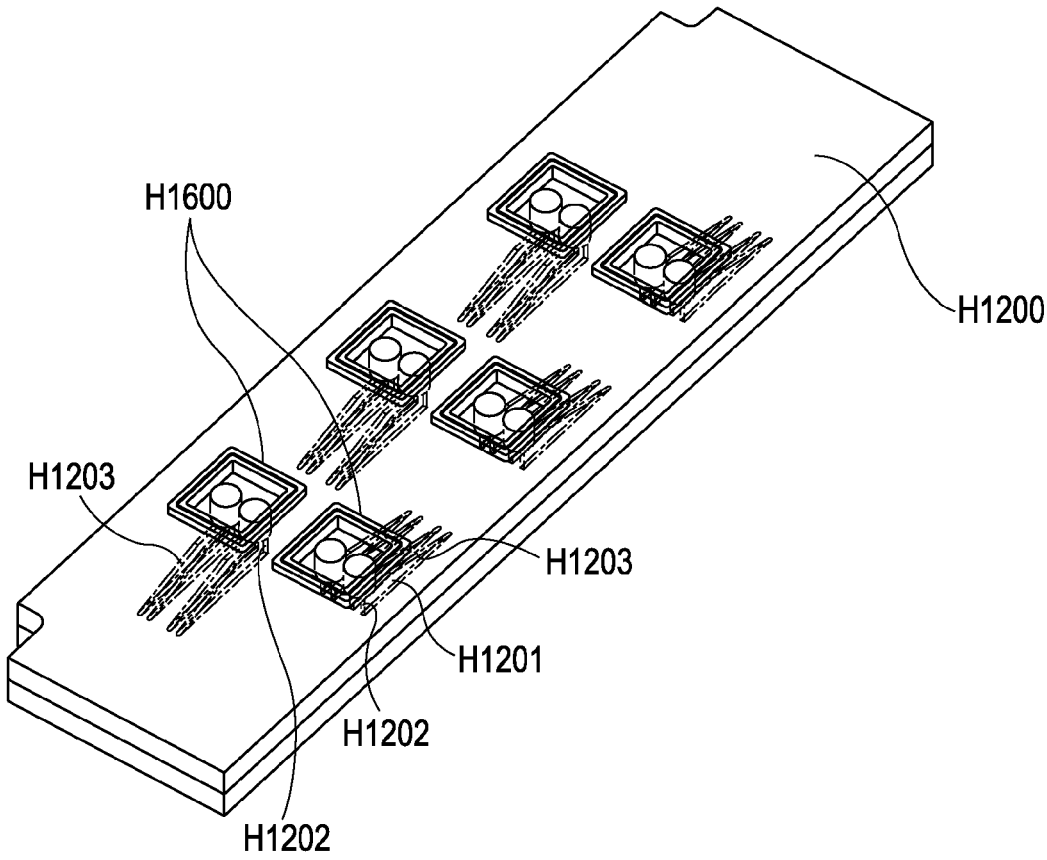
FIG. 11A is a schematic view of an arrangement of filters of the recording head.
Figure 11B:
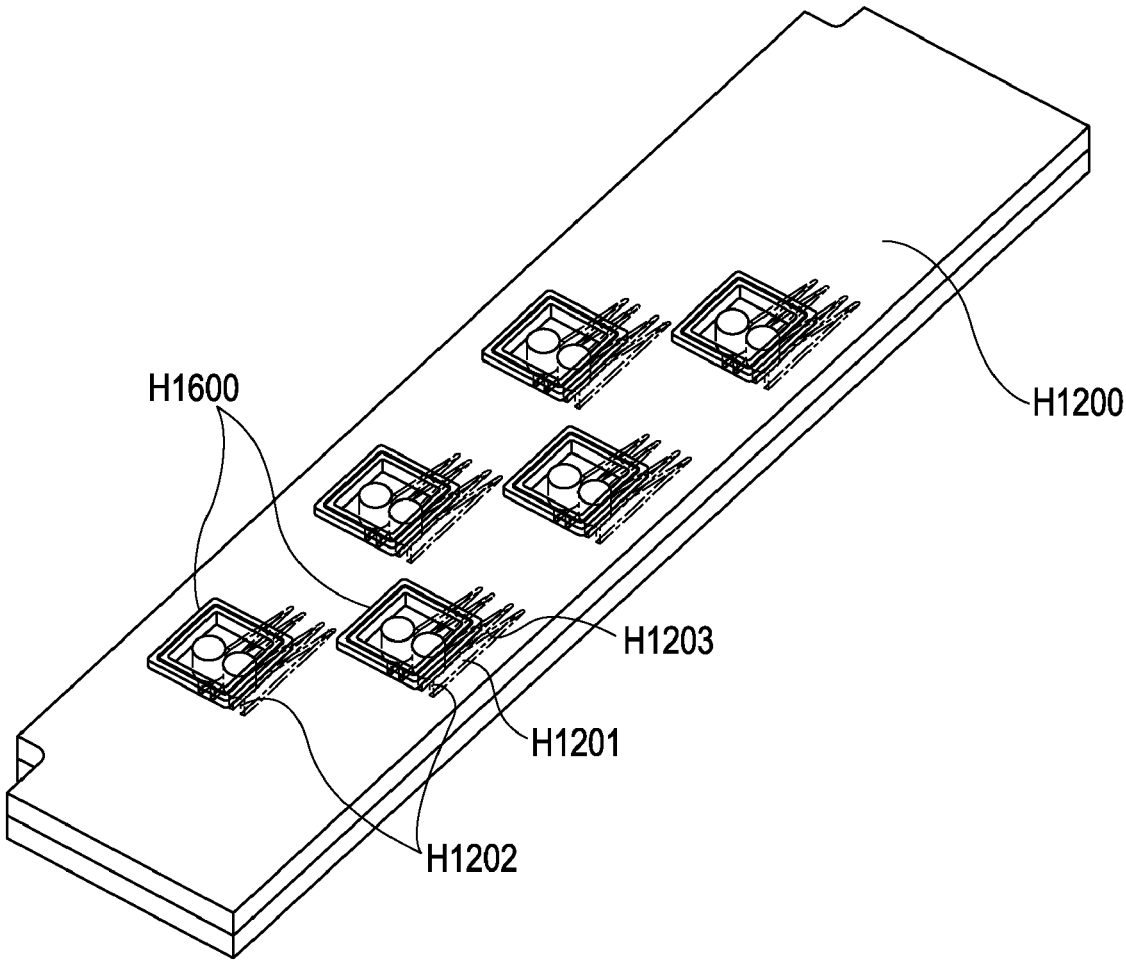
FIG. 11B is a schematic view of an arrangement of the filters of the recording head.

Primarily referring to FIGS. 9 to 13, a recovery operation of the recording head and the structure of the recording head associated thereto will now be described. FIG. 9 is a conceptual diagram of an ink supply path. FIG. 10A is a perspective view of the recording head. FIG. 10B is a sectional view taken along line XB-XB in FIG. 10A. FIG. 10C is an enlarged sectional view of a portion E in FIG. 10B. FIGS. 10B and 10C show ink flow into the recording head. FIGS. 11A, 11B, and FIG. 12 are schematic views of the arrangements of the filters of the recording head. FIG. 13 is a schematic view of an inkjet recording apparatus of another practical form using the recording head according to the embodiment of the present invention.

In an image forming apparatus using an inkjet recording head, in general, a recovery operation is performed by forcing ink to flow into the head and discharging the ink from the nozzles H1105. The recovery operation is performed when the recording heads 15 mounted to the recording apparatus S are filled with ink. In addition, the recovery operation is performed for overcoming, for example, image defect resulting from, for example, clogging of the nozzles H1105 caused by ink clotting in the nozzles H1105 or air bubbles accumulated in the nozzles H1105 or the liquid supply flow paths H1201.

FIG. 9 is a conceptual diagram of an ink supply path in the embodiment. A main ink tank 41 and a sub ink tank 42 are connected to each other with a tube, and a main pump 44 is disposed in a path between the main ink tank 41 and the sub ink tank 42. In addition, the sub ink tank 42 and the recording heads 15 are connected to each other with a tube, and a sub pump 45 is disposed in a path between the sub ink tank 42 and the recording heads 15. Further, the recording heads 15 are connected to the main ink tank 41 and to the sub ink tank 42 with a first bulb 47 and a second bulb 48. When an instruction for executing a recovery operation is transmitted from a controller (not shown) in the recording apparatus S, the sub pump 45 forcefully pushes out ink from the nozzles H1105 of the recording element substrates H1100 of the recording heads 15. The ink that has been pushed out from the recording heads 15 accumulates in the caps 20, from where the ink is recovered to a waste ink tank 43 by a waste ink pump 46. When the forced discharge of the ink from the nozzles H1105 is completed, a wiping operation is performed for cleaning the surfaces of the recording heads 15 where the recording element substrates H1100 are mounted. This causes the recording head 15 to be in a state in which they can properly discharge the ink. Recovery methods other than the above-described recovery method that forcefully discharges ink from the nozzles H1105 by increasing the internal pressure of the recording heads 15 may also be performed. For example, the recovery method may be one that forcefully sucks ink from the nozzles H1105 by, for example, a pump after the surfaces of the recording heads 15 where the recording element substrates H1100 are mounted are covered by the caps 20.

The flow of the ink in the recording heads 15 when the recovery operation is performed is as shown in FIGS. 10B and 10C. Each liquid supply flow path H1201 (see, for example, FIG. 6) is formed so that one side is defined by a vertical wall H1202 and the opposite side is defined by an inclined wall H1203 in the longitudinal direction of each nozzle group H1106. Each vertical wall H1202 is substantially perpendicular to the surface of the recording element substrate H1100 that contacts the first plate H1200. Each inclined wall H1203 faces and forms an acute angle with the surface of the recording element substrate H1100 contacting the first plate H1200. Each liquid supply flow path H1201 has a form that allows it to communicate with the corresponding filter H1600 at the top side thereof adjacent to the vertical wall H1202. By virtue of this structure, ink roughly flows in the direction of the arrows shown in FIGS. 10B and 10C, so that the ink passes through each filter H1600 and is pushed out towards each inclined wall H1203. That is, the liquid supply flow paths H1201 is formed with a shape so that, when the recovery operation is performed, air bubbles in ink liquid chambers between the filters H1600 and the recording element substrates H1100 are effectively pushed out and easily removed from the nozzles H1105. The ink liquid chambers between the filters H1600 and the recording element substrates H1100 are spaces surrounded by the filters H1600 and the nozzles H1105 of the recording element substrates H1100. Accordingly, air bubbles produced during ink discharge or air bubbles produced by, for example, elution of gas in the ink tend to accumulate in these spaces. Therefore, it is necessary to overcome the problem that the ink discharge can no longer be performed from the nozzles H1105 due to the flow of the ink passing through the liquid supply flow paths H1201 being blocked by a large number of accumulated air bubbles. Consequently, the liquid supply flow paths H1201 are required to have forms that allow them to, by the recovery operation, effectively push out and easily remove the air bubbles, produced in the ink liquid chambers between the filters H1600 and the recording element substrates H1100, from the nozzles H1105.

As shown in FIG. 11A, the orientations of the vertical walls H1202 and the inclined walls H1203 of the respective liquid supply flow paths H1201 are reversed with every row along the direction of arrangement of the recording element substrates H1100 (that is, in the longitudinal direction of the recording element substrates H1100). That is, the vertical walls H1202 and the inclined walls H1203 of the liquid supply flow paths H1201 are formed so that their orientations are opposite to each other with every row of recording element substrates H1100 disposed in a staggered arrangement on the first plate H1200. In other words, in the liquid supply flow paths H1201 that supply ink to the respective ink supply ports H1101 of the recording element substrates H1100 that are arranged in a certain row, the inclined walls H1203 extend in a first direction along the direction of arrangement of the recording element substrates with respect to the vertical walls H1202. In the liquid supply flow paths H1201 that supply ink to the respective ink supply ports H1101 of the recording element substrates H1100 that are arranged in another row that is adjacent to the certain row, the arrangement of the inclined walls H1203 with respect to the vertical walls H1202 differs. That is, the inclined walls H1203 extend in a second direction that is opposite to the first direction along the direction of arrangement of the recording element substrates with respect to the vertical walls H1202.

In the structure shown in FIG. 11B, the direction of arrangement of the vertical walls H1202 of the liquid supply flow paths H1201 and the direction of arrangement of the inclined walls H1203 of the liquid supply flow paths H1201 are the same, and the filters H1600 are disposed in a staggered arrangement. In contrast, the liquid supply flow paths H1201 shown in FIG. 11A are formed so that one side is defined by the vertical walls H1202 and the opposite side is defined by the inclined walls H1203 along the longitudinal direction of the nozzle groups H1106. In addition, the liquid supply flow paths H1201 shown in FIG. 11A communicate with the filters H1600 at the top sides thereof adjacent to the vertical walls H1202. Therefore, according to the structure shown in FIG. 11A, the filters H1600 can be disposed in a matrix instead of disposing the filters H1600 of adjacent rows in a staggered arrangement as shown in FIG. 11B.

In the structure shown in FIG. 11A, the liquid supply flow paths H1201 are disposed along the direction of arrangement of the discharge ports. As shown in FIG. 11A, the liquid supply flow paths H1201 are long in the direction of arrangement of the discharge ports. In correspondence with the recording element substrates H1100 disposed in rows, groups of filters H1600 and liquid supply flow paths H1201 are also formed in rows. Here, in the liquid supply flow paths H1201 in one of the rows, the filters H1600 are disposed at one end side in the direction of arrangement of the discharge ports. In the liquid supply flow paths H1201 in another row adjacent to the one of the rows, the filters H1600 are disposed at an end side opposite to the one end side.

Figure 12A:
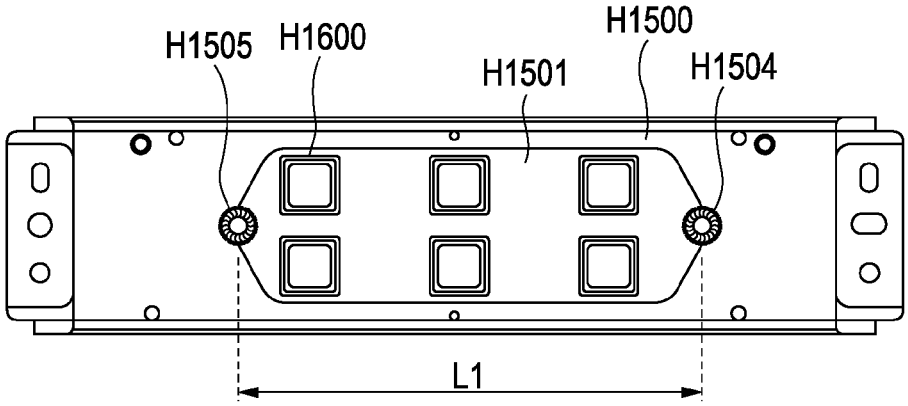
FIGS. 12A and 12B are schematic views of the arrangements of the filters of the recording head.
Figure 13:
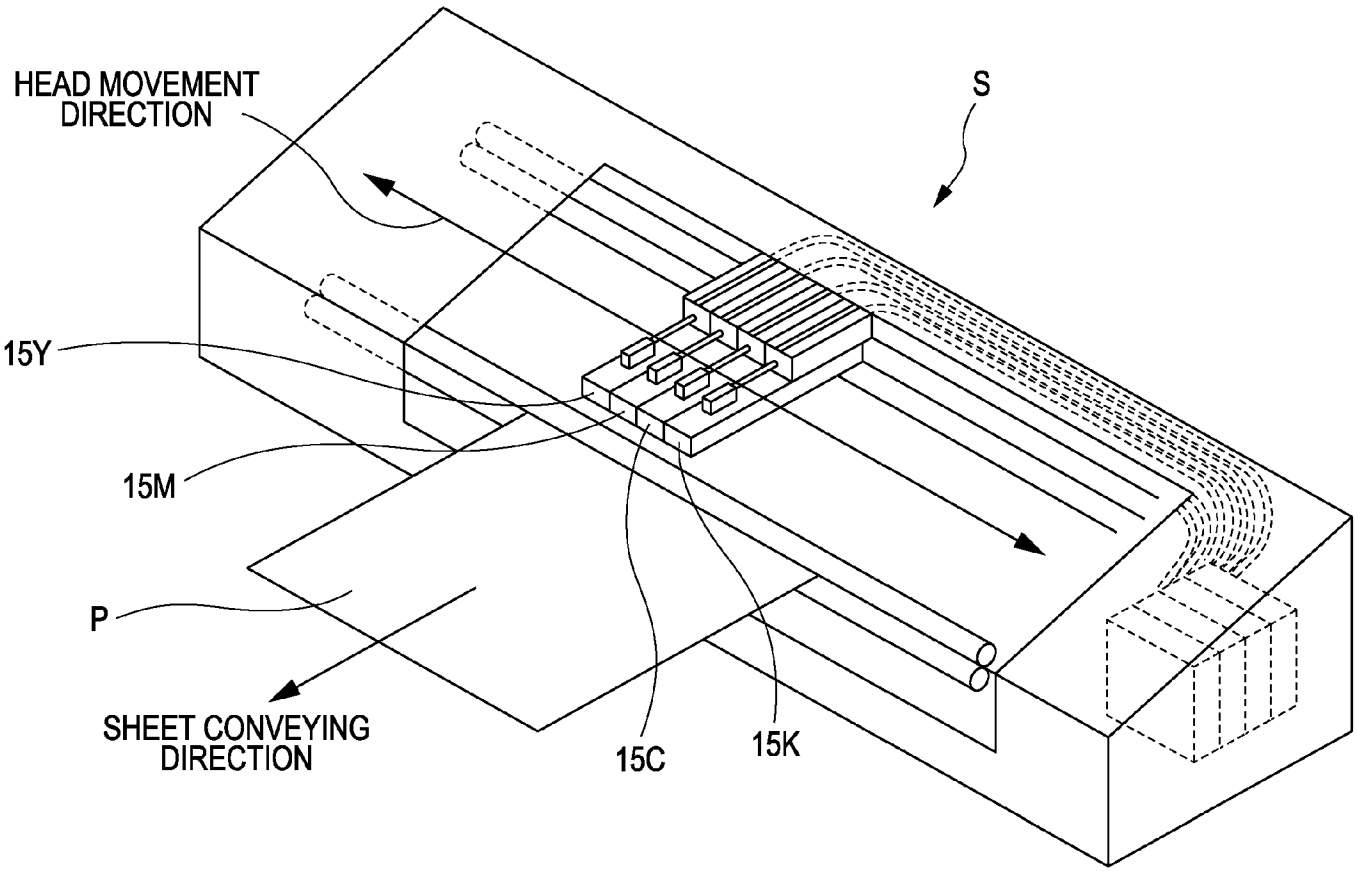
FIG. 13 is a schematic view of an inkjet recording apparatus of another practical form using the recording head according to the embodiment of the present invention.

FIG. 12A shows an ink supply member corresponding to the configuration of the filters shown in FIG. 11A, and FIG.

Figure 12B:
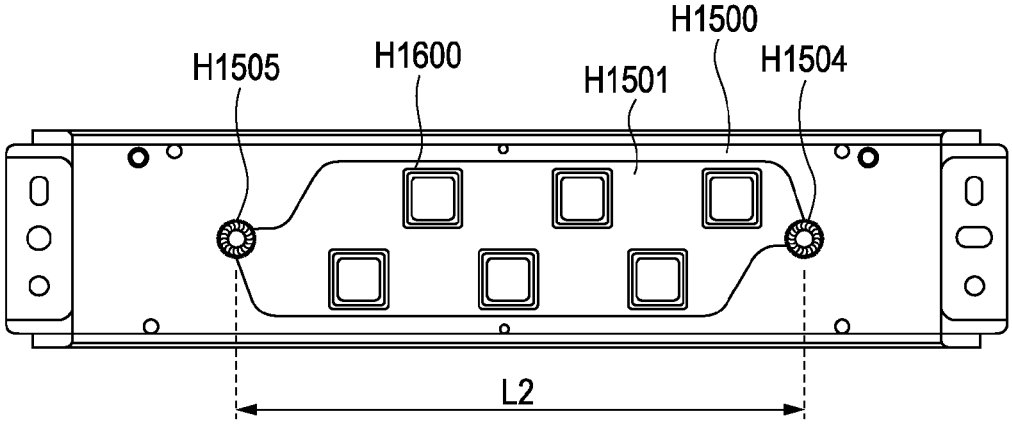

12B shows an ink supply member corresponding to the configuration of the filters shown in FIG. 11B. Lengths L1 and L2 in the longitudinal direction of the ink supply liquid chambers H1501 of the ink supply members H1500 required to cover all the filters H1600 are compared to each other. The lengths L1 and L2 correspond to the distances between ink entrances H1504 and respective ink exits H1505. As shown in FIG. 12, the length L1 in the structure shown in FIG. 12A is shorter than the length L2 in the structure shown in FIG. 12B. As shown in FIGS. 12A and 12B, when the filters in one of the rows and the filters in the other row adjacent to the one of the rows overlap each other in a direction perpendicular to the direction of arrangement of the discharge ports, the length L1 can be made shorter, which is desirable.

Therefore, when the vertical walls H1202 and the inclined walls H1203 of the liquid supply flow paths H1201 are formed as shown in FIG. 11A, the ink supply members H1500 can be reduced in size as shown in FIG. 12A. As a result, the recording heads 15 can be reduced in size, so that the caps 20, the cleaning mechanism 35, etc., can be reduced in size. Consequently, the overall size of the recording apparatus S can be reduced.

In the embodiment, four rows of the nozzle groups H1106 are disposed on each recording element substrate H1100, and the liquid supply flow paths H1201 are divided into four rows accordingly. However, the number of nozzle groups H1106 disposed on each recording element substrate H1100, and the number of divisions of the liquid supply flow paths H1201 corresponding thereto are not limited to those mentioned above. In addition, although, in the embodiment, two rows of the recording element substrates H1100 are disposed in a staggered arrangement on the first plate H1200, the number of rows and configuration of the recording element substrates H1100 that are disposed on the first blade H1200 are not limited thereto.

Each recording head 15 according to the embodiment is a full-line inkjet recording head in which nozzles and electrothermal transducers are arranged over an entire width of a recording medium in a direction intersection the conveying direction of the recording medium disposed in a recording area of the corresponding recording head 15. In addition, the inkjet recording apparatus according to the embodiment includes recording heads 15 that are fixed, and allows a recording medium to pass below the recording heads 15 to form an image. The structures of the recoding heads 15 and the recording apparatus are not limited thereto. For example, as shown in FIG. 13, the inkjet recording apparatus may be a serial-scan type inkjet recording apparatus that forms images as a result of causing the recording heads to reciprocate a plurality of times above a recording medium.

Second Exemplary Embodiment

Figure 14:
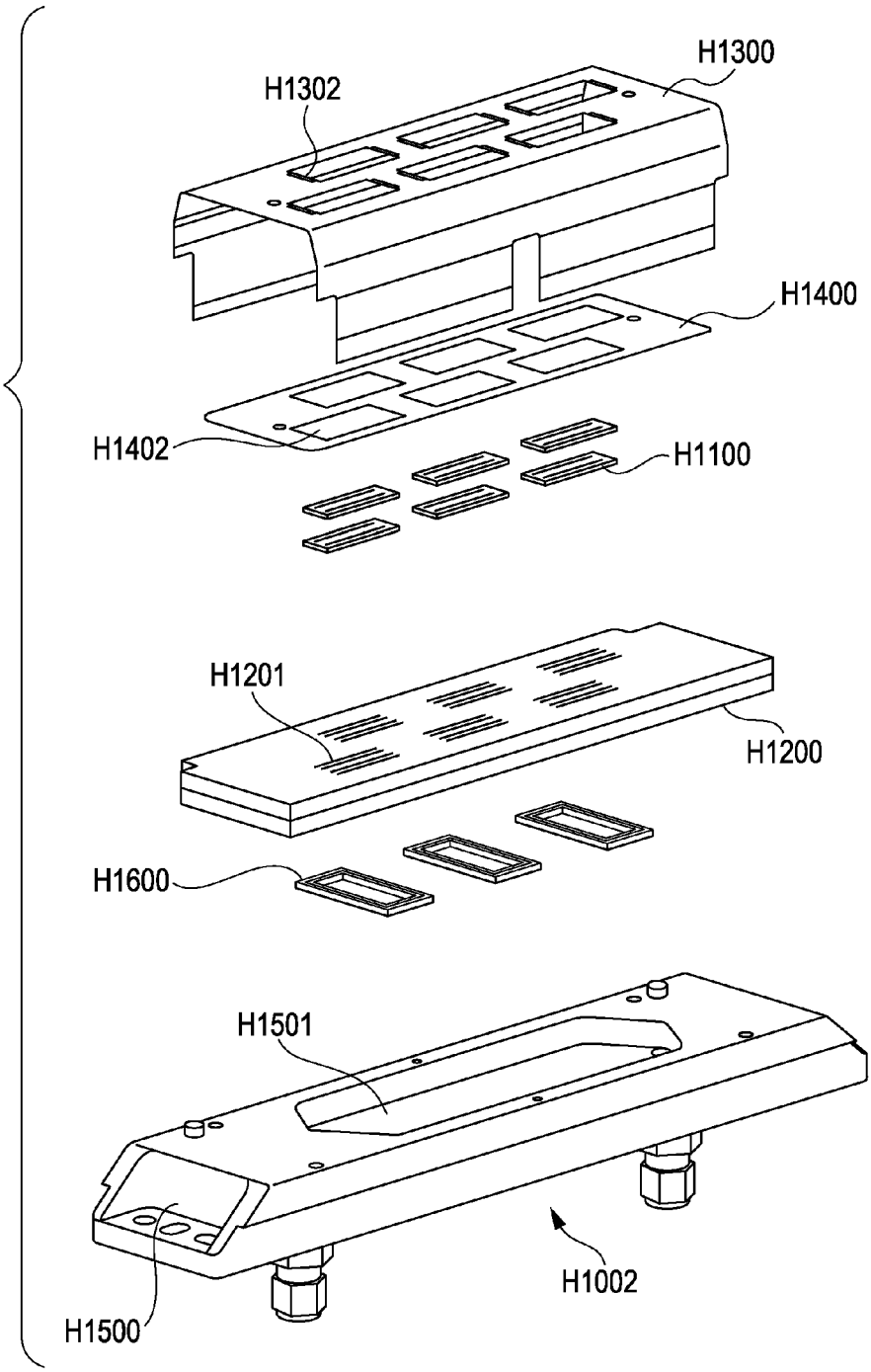
FIG. 14 is an exploded perspective view of a recording head according to a second embodiment of the present invention.
Figure 15:
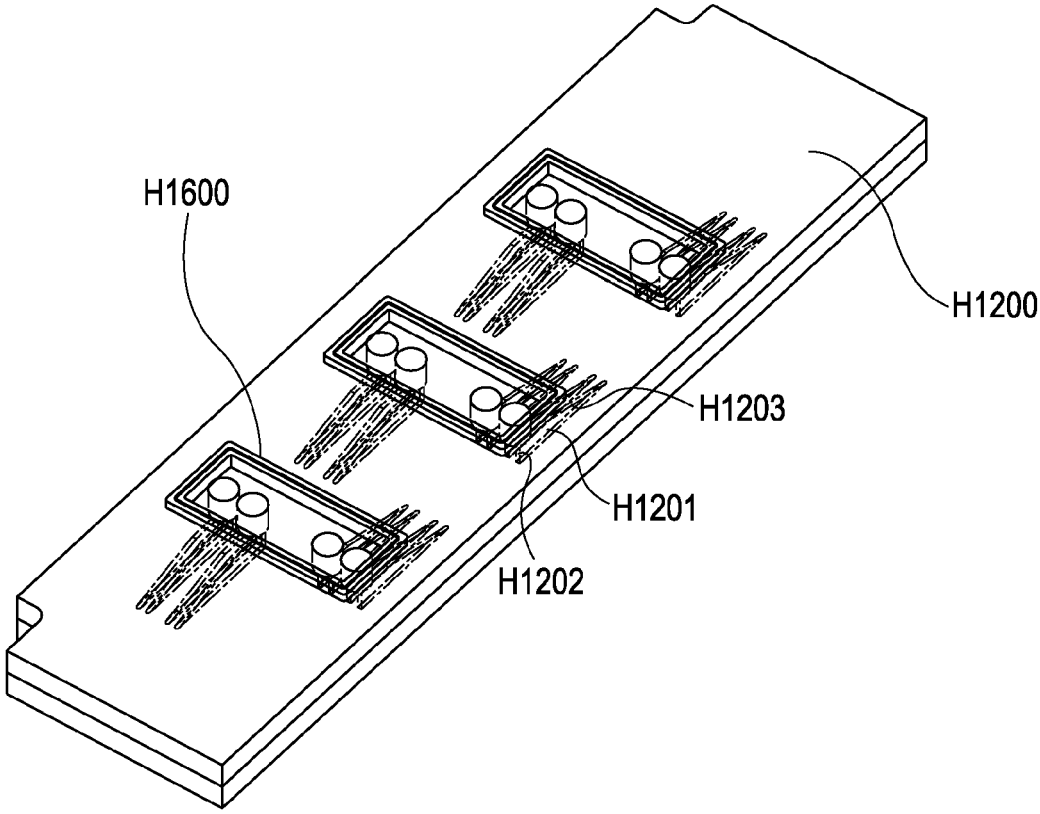
FIG. 15 is a perspective view of an arrangement of filters shown in FIG. 14.

A second exemplary embodiment of the present invention will now be described with reference to FIGS. 14 and 15. FIG. 14 is an exploded perspective view of a recording head according to the second exemplary embodiment of the present invention. FIG. 15 is a perspective view of an arrangement of filters of the recording head shown in FIG. 14. In these figures, structural features that are the same as or correspond to those of the recording head according to the first embodiment are given the same reference numerals as those used in the first embodiment.

In each recording head 15 according to the first embodiment, the number of groups of liquid supply flow paths H1201 corresponds to the number of recording element substrates H1100, and the filters H1600 are adhered and secured with every group of the liquid supply flow paths H1201.

In contrast, in the embodiment, as shown in FIGS. 14 and 15, two groups of liquid supply flow paths H1201 that are adjacent to each other in a transverse direction of the recording element substrate H1100 and that are in respective rows form one set. One filter H1600 is adhered and secured to each set. Accordingly, as in the first embodiment, the liquid supply flow paths H1201 are arranged in different orientations. This makes it possible to use in common the filter H1600 for the liquid supply flow paths H1201 adjacent to each other and in respective rows, so that the number of filters H1600 and the number of assembly manhours can be reduced.

Third Exemplary Embodiment

Figure 16:
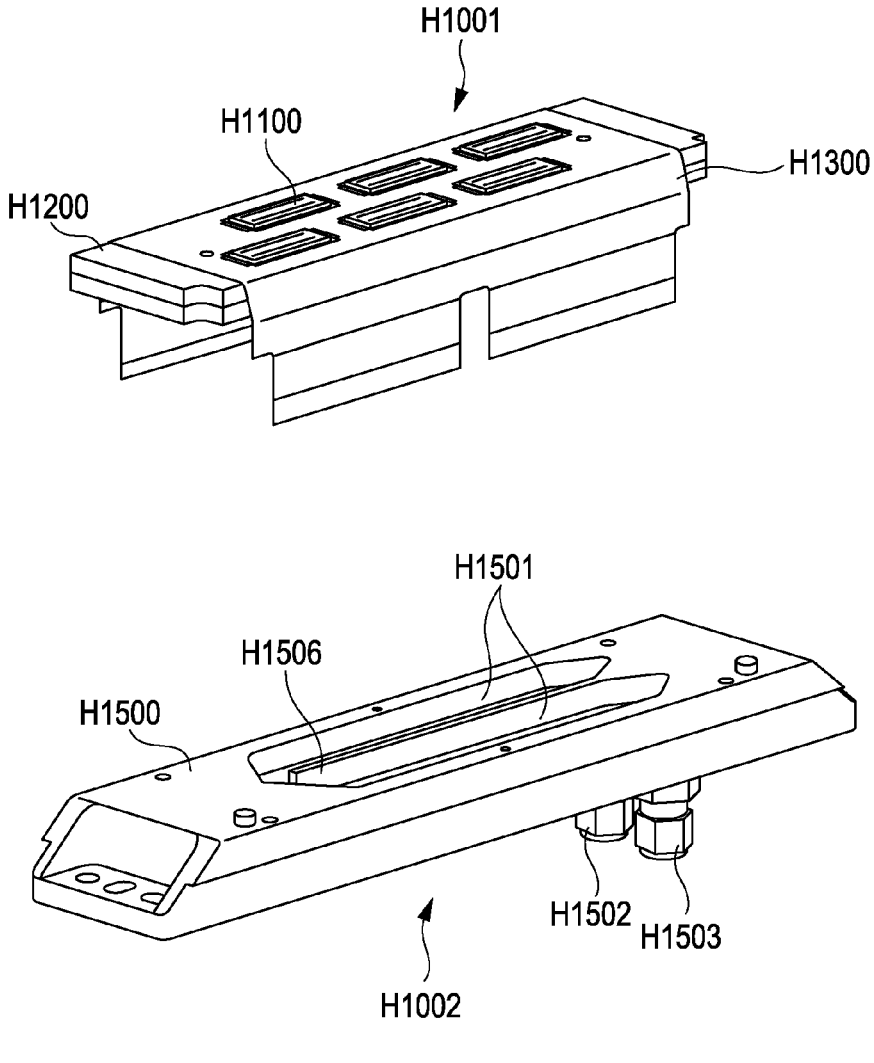
FIG. 16 is an exploded perspective view of a recording head according to a third embodiment of the present invention.
Figure 17:
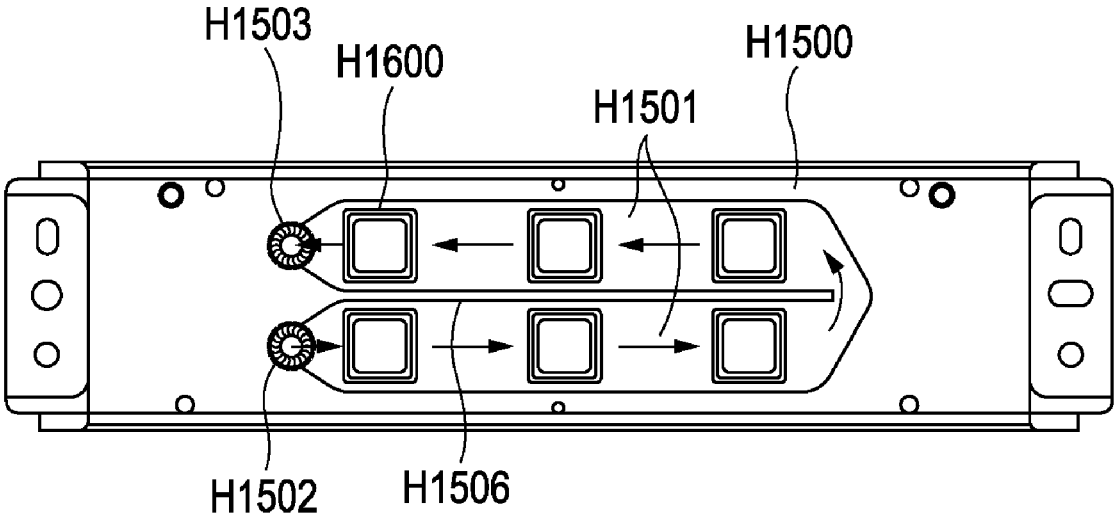
FIG. 17 is a plan view of an arrangement of filters of the recording head shown in FIG. 16.

A third exemplary embodiment of the present invention will now be described with reference to FIGS. 16 and 17. FIG. 16 is an exploded perspective view of a recording head according to a third embodiment of the present invention. FIG. 17 is a plan view of the arrangement of filters of the recording head shown in FIG. 16. In these figures, structural features that are the same as or correspond to those of the recording heads according to the first and second embodiments are given the same reference numerals as those used in the first and second embodiments.

Each of the ink supply units H1002 of the recording heads 15 according to the first and second embodiments is provided with the ink entrance member H1502 and the ink exit member H1503 at the respective ends in the longitudinal direction of the corresponding recording head 15 of the ink supply liquid chamber H1501.

In contrast, in the third embodiment, as shown in FIG. 16, a partition member H1506 that divides an ink supply liquid chamber H1501 along the direction of arrangement of recording element substrates H1100 that are disposed in a staggered arrangement on a first plate H1200 is provided in the ink supply liquid chamber H1501. In addition, an ink entrance member H1502 and an ink exit member H1503 are both disposed at one side of the recording head 15 in the longitudinal direction thereof. In this structure, the flow of ink in the recording head 15 (ink supply liquid chamber H1501) is as indicated by the arrows shown in FIG. 17. That is, the partition member H1506 restricts the flow of ink in the ink supply liquid chamber H1501 in the direction in which an inclined wall H1203 extends with respect to a vertical wall H1202 of a liquid supply flow path H1201 formed in a first plate H1200.

According to the structure of the third embodiment, the ink entrance member H1502 and the ink exit member H1503 can be concentrated at the same side of the recording head 15 in the longitudinal direction. Therefore, for example, ink pipelines that are connected to the members H1502 and H1503 can be concentrated at the back side in a recording apparatus. Consequently, the recording apparatus can be further simplified.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Application No. 2007-121100 filed May 1, 2007, which is hereby incorporated by reference herein in its entirety.

What is claimed is:

1. An inkjet recording head comprising:

a plurality of recording element substrates having a plurality of discharge ports, a plurality of recording elements, and a plurality of liquid supply ports, the discharge ports and the recording elements being disposed in a plurality of rows, the discharge ports being configured to discharge liquid, the recording elements being configured to generate discharge energy for discharging the liquid from the discharge ports, the liquid supply ports facilitating supplying the liquid to the recording elements; and a supporting plate having the recording element substrates disposed in a plurality of rows on one surface of the supporting plate in a direction of arrangement of the discharge ports and the recording elements, the supporting plate having a plurality of liquid supply flow paths facilitating supplying the liquid to the liquid supply ports at the respective recording elements, wherein each liquid supply flow path is defined by a vertical wall and an inclined wall, each vertical wall being perpendicular to a surface of the corresponding recording element substrate that contacts the supporting plate, each inclined wall opposing the surface of the corresponding recording element substrate and forming an acute angle with the surface of the corresponding recording element substrate, wherein, in the liquid supply flow paths that supply the liquid to the liquid supply ports at the respective recording element substrates that are arranged in one of the rows, the inclined walls extend in a first direction along the direction of arrangement of the recording element substrates with respect to the vertical walls, and wherein, in the liquid supply flow paths that supply the liquid to the liquid supply ports at the respective recording element substrates that are arranged in another of the rows that is adjacent to the one of the rows, the inclined walls extend in a second direction opposite to the first direction, with respect to the vertical walls.

2. The inkjet recording head according to claim 1, further comprising:

a filter disposed at a surface of the supporting member that is opposite to the one surface of the supporting plate; and a liquid supply member defining a liquid chamber, the liquid chamber being disposed between the liquid supply member and the supporting plate, the liquid chamber accommodating the filter and receiving the liquid, wherein the liquid chamber has a partition member, the partition member restricting to the first direction a direction of flow of the liquid in the liquid chamber with respect to the liquid supply ports at which the inclined walls extend in the first direction with respect to the vertical walls, the partition member restricting to the second direction a direction of flow of the liquid in the liquid chamber with respect to the liquid supply ports at which the inclined walls extend in the second direction with respect to the vertical walls.

3. The inkjet recording head according to claim 2, wherein the number of filters is less than the number of recording element substrates.

4. The inkjet recording head according to claim 1, wherein the inkjet recording head is a full-line inkjet recording head having the discharge ports and the recording elements arranged over an entire width of a recording medium in a direction intersecting a conveying direction of the recording medium disposed in a recording area of the inkjet recording head.

5. An inkjet recording apparatus that performs a recording operation comprising the inkjet recording head according to claim 1.

6. An inkjet recording head comprising:

a plurality of recording element substrates having discharge ports, a plurality of recording elements, and a plurality of liquid supply ports, the discharge ports being configured to discharge liquid, the recording elements being configured to generate discharge energy for discharging the liquid from the discharge ports, the liquid supply ports facilitating supplying the liquid to the recording elements; and a supporting plate having the recording element substrates disposed in a plurality of rows on one surface of the supporting plate along a direction of arrangement of the discharge ports, the supporting plate having a plurality of liquid supply flow paths and filters, the liquid supply flow paths supplying the liquid to the liquid supply ports at the respective recording elements, the filters being disposed at a surface of the supporting member that is at the back side of the one surface of the supporting plate, the filters communicating with the liquid supply flow paths, wherein the liquid supply flow paths at the one surface of the supporting plate are longer in the direction of arrangement of the discharge ports than in a direction perpendicular to the direction of arrangement of the discharge ports, wherein, in the liquid supply flow paths corresponding to the recording element substrates that are arranged in one of the rows, the filters are disposed at one end side thereof in the direction of arrangement of the discharge ports, and wherein, in the liquid supply flow paths corresponding to the recording element substrates that are arranged in another one of the rows that is adjacent to the one of the rows, the filters are disposed at another end side thereof, which is opposite to the one end side, in the direction of arrangement of the discharge ports.

7. The inkjet recording head according to claim 6, wherein the filters in the one of the rows and the filters in the another one of the rows adjacent to the one of the rows overlap each other in the direction perpendicular to the direction of arrangement of the discharge ports.

* * * * *